US007451594B2

(12) United States Patent
Blaisdell

(10) Patent No.: US 7,451,594 B2
(45) Date of Patent: Nov. 18, 2008

(54) EXHAUST FLOW DISTRIBUTION DEVICE

(75) Inventor: Jared D. Blaisdell, Bloomington, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 0 days.

(21) Appl. No.: 11/238,647

(22) Filed: Sep. 28, 2005

(65) Prior Publication Data

US 2006/0070375 A1 Apr. 6, 2006

Related U.S. Application Data

(60) Provisional application No. 60/615,180, filed on Oct. 1, 2004.

(51) Int. Cl.
*F01N 7/00* (2006.01)

(52) U.S. Cl. ..... 60/324; 60/299

(58) Field of Classification Search ..... 60/29, 60/299, 311, 324; 422/168, 176, 177
See application file for complete search history.

(56) References Cited

U.S. PATENT DOCUMENTS

| | | | | |
|---|---|---|---|---|
| 677,357 | A | 7/1901 | Hyde | |
| 2,363,236 | A | 11/1944 | Fluor | |
| 2,721,619 | A | 10/1955 | Cheairs | |
| 2,732,913 | A | 1/1956 | Higgins | |
| 3,180,712 | A | 4/1965 | Hamblin | |
| 3,380,810 | A | 4/1968 | Hamblin | |
| 3,445,196 | A | 5/1969 | Thomas | |
| 3,645,093 | A | 2/1972 | Thomas | |
| 3,672,464 | A | 6/1972 | Rowley et al. | |
| 3,719,457 | A | 3/1973 | Nagamatsu | |
| 3,754,398 | A | 8/1973 | Mattavi | |
| 3,780,772 | A | 12/1973 | Carnanhan et al. | |
| 3,852,042 | A | 12/1974 | Wagner | |
| 3,964,875 | A | 6/1976 | Chang et al. | |
| 3,972,687 | A | 8/1976 | Frietzsche | |
| 4,002,433 | A | 1/1977 | Öser | |
| 4,004,887 | A | 1/1977 | Stormont | |
| 4,017,347 | A | 4/1977 | Cleveland | |
| 4,032,310 | A | 6/1977 | Ignoffo | |
| 4,050,903 | A | 9/1977 | Bailey et al. | |
| 4,054,418 | A | 10/1977 | Miller et al. | |
| 4,086,063 | A | 4/1978 | Garcea | |
| 4,124,091 | A | 11/1978 | Mizusawa | |
| 4,183,896 | A * | 1/1980 | Gordon | 422/168 |

(Continued)

FOREIGN PATENT DOCUMENTS

| | | |
|---|---|---|
| CA | 721202 | 11/1965 |

(Continued)

OTHER PUBLICATIONS

U.S. Appl. No. 11/223,460, filed Sep. 8, 2005.

*Primary Examiner*—Thomas Denion
*Assistant Examiner*—Diem Tran
(74) *Attorney, Agent, or Firm*—Merchant & Gould, P.C.

(57) ABSTRACT

The disclosure is directed to a flow distributor for use to maximize the efficiency and working life of a catalytic converter. The flow distributor is configured such that it directs the gas flow in the center of the exhaust gas stream to the periphery of the gas stream thereby resulting in a more uniform velocity flow pattern.

2 Claims, 5 Drawing Sheets

U.S. PATENT DOCUMENTS 4,209,493 A 6/1980 Olson
4,297,116 A 10/1981 Cusick
4,328,188 A 5/1982 Kawata
4,368,799 A 1/1983 Wagner
4,393,652 A 7/1983 Munro
4,416,674 A 11/1983 McMahon et al.
4,426,844 A 1/1984 Nakano
4,427,836 A 1/1984 Kowalski et al.
4,538,413 A 9/1985 Shinzawa et al.
4,541,240 A 9/1985 Munro
4,580,657 A 4/1986 Schmeichel et al.
4,601,168 A 7/1986 Harris
4,632,216 A 12/1986 Wagner et al.
4,634,459 A 1/1987 Pischinger et al.
4,652,286 A 3/1987 Kusuda et al.
4,730,454 A 3/1988 Pischinger et al.
4,732,743 A 3/1988 Schmidt et al.
4,797,263 A 1/1989 Oza
4,851,015 A 7/1989 Wagner et al.
4,854,123 A 8/1989 Inoue
4,866,932 A 9/1989 Morita et al.
4,867,768 A * 9/1989 Wagner et al. ..... 96/386
4,890,690 A 1/1990 Fischer et al.
4,902,309 A 2/1990 Hempenstall
4,969,537 A 11/1990 Wagner et al.
5,021,227 A 6/1991 Kobayashi et al.
5,043,147 A 8/1991 Knight
5,053,062 A 10/1991 Barris et al.
5,065,576 A 11/1991 Kanazawa et al.
5,082,478 A 1/1992 Oono et al.
5,110,560 A 5/1992 Presz, Jr. et al.
5,139,107 A 8/1992 Nagai
5,140,813 A 8/1992 Whittenberger
5,170,020 A 12/1992 Kruger et al.
5,171,341 A 12/1992 Merry
5,184,464 A 2/1993 Harris
5,185,998 A 2/1993 Brew
5,209,062 A 5/1993 Vollenweider
5,220,789 A 6/1993 Riley et al.
5,321,215 A 6/1994 Kicinski
5,322,537 A 6/1994 Nakamura et al.
5,339,630 A 8/1994 Pettit
5,355,973 A 10/1994 Wagner et al.
5,378,435 A 1/1995 Gavoni
5,408,828 A 4/1995 Kreucher et al.
5,426,269 A 6/1995 Wagner et al.
5,453,116 A 9/1995 Fischer et al.
5,457,945 A 10/1995 Adiletta
5,484,575 A 1/1996 Steenackers
5,584,178 A 12/1996 Naegeli et al.
5,611,832 A 3/1997 Suzuki et al.
5,643,536 A 7/1997 Schmelz
5,720,787 A 2/1998 Kasai et al.
5,732,555 A 3/1998 Gracyalny et al.
5,737,918 A 4/1998 Khinsky et al.
5,758,497 A 6/1998 Frederiksen et al.
5,771,689 A 6/1998 Bareis et al.
5,808,245 A 9/1998 Wiese et al.
5,828,013 A 10/1998 Wagner et al.
5,908,480 A 6/1999 Ban et al.
5,916,134 A 6/1999 Yang et al.
5,921,079 A 7/1999 Harris
5,992,141 A 11/1999 Berriman et al.
6,003,305 A 12/1999 Martin et al.
6,041,594 A 3/2000 Brenner et al.
6,050,088 A 4/2000 Brenner
6,082,487 A 7/2000 Angelo et al.
6,550,573 B2 * 4/2003 Wagner et al. ..... 181/255
6,712,869 B2 3/2004 Cheng et al.
6,892,854 B2 5/2005 Wagner et al.
2002/0073698 A1 6/2002 D'Herde et al.
2002/0162319 A1 11/2002 Crocker et al.

FOREIGN PATENT DOCUMENTS

CA 796934 10/1968
DE 673 707 3/1939
DE 2 314 465 10/1974
DE 40 17 267 A1 12/1990
DE 44 17 238 A1 9/1994
EP 0 158 625 A1 10/1985
EP 0 220 484 A2 5/1987
EP 0 220 505 A2 5/1987
EP 0 226 022 A1 6/1987
FR 2 197 411 3/1974
GB 2 383 548 A 7/2003
JP 54-137530 10/1979
JP 57-158917 9/1982
JP 62-160726 7/1987
JP 63-140123 6/1988
JP 3-10016 1/1991
JP 3-21313 1/1991
JP 5-288047 11/1993
SU 1163889 A 6/1985
WO WO 89/01566 2/1989
WO WO 93/24744 12/1993

* cited by examiner

EXHAUST FLOW DISTRIBUTION DEVICE

CROSS REFERENCE TO RELATED APPLICATION

This application claims the benefit of U.S. Provisional Patent Application Ser. No. 60/615,180, filed Oct. 1, 2004, which application is hereby incorporated by reference in its entirety.

TECHNICAL FIELD

The present disclosure relates generally to an exhaust flow distribution device. More particularly, the disclosure relates to a device capable of altering the exhaust gas velocity profile upstream of an exhaust aftertreatment device.

BACKGROUND

The natural velocity profile of exhaust gas in a muffler flowing towards the inlet of an exhaust aftertreatment device (e.g., a catalytic converter or diesel particulate filter) resembles a parabolic curve with the velocity maximum at the center of the flow distribution and decreasing significantly outwardly towards the periphery of the flow distribution. This non-uniform velocity flow distribution shortens the useful lives of the aftertreatment devices, and reduces their operational efficiency.

Various flow distribution devices have been used to create a more uniform velocity flow profile. U.S. Pat. Nos. 5,355,973; 5,732,555; 5,185,998; and 4,797,263 disclose exemplary flow distribution devices that can be used to prolong the useful life and efficiency of exhaust aftertreatment devices. However, these flow distribution devices typically either impede fluid flow causing an undesirable increase in backpressure or do not adequately distribute flow across the face of their corresponding exhaust aftertreatment device. Consequently, there is a need for improved flow distribution devices that provide an effective flow distribution while at the same time generating reduced backpressure.

SUMMARY

One aspect of the present disclosure is to provide a flow distribution device that is constructed such that it effectively distributes flow without generating unacceptable levels of backpressure. In particular, the flow distribution device includes a plate adapted to be disposed across the flow path of exhaust gas in an exhaust system. The flow distribution device includes a plurality of apertures that define open spaces in the plate. The open spaces are largest adjacent the periphery region of the flow path where the natural flow velocity is slowest and are smallest adjacent the center region of the flow path where the natural flow velocity is fastest.

DETAILED DESCRIPTION

Figure 1:
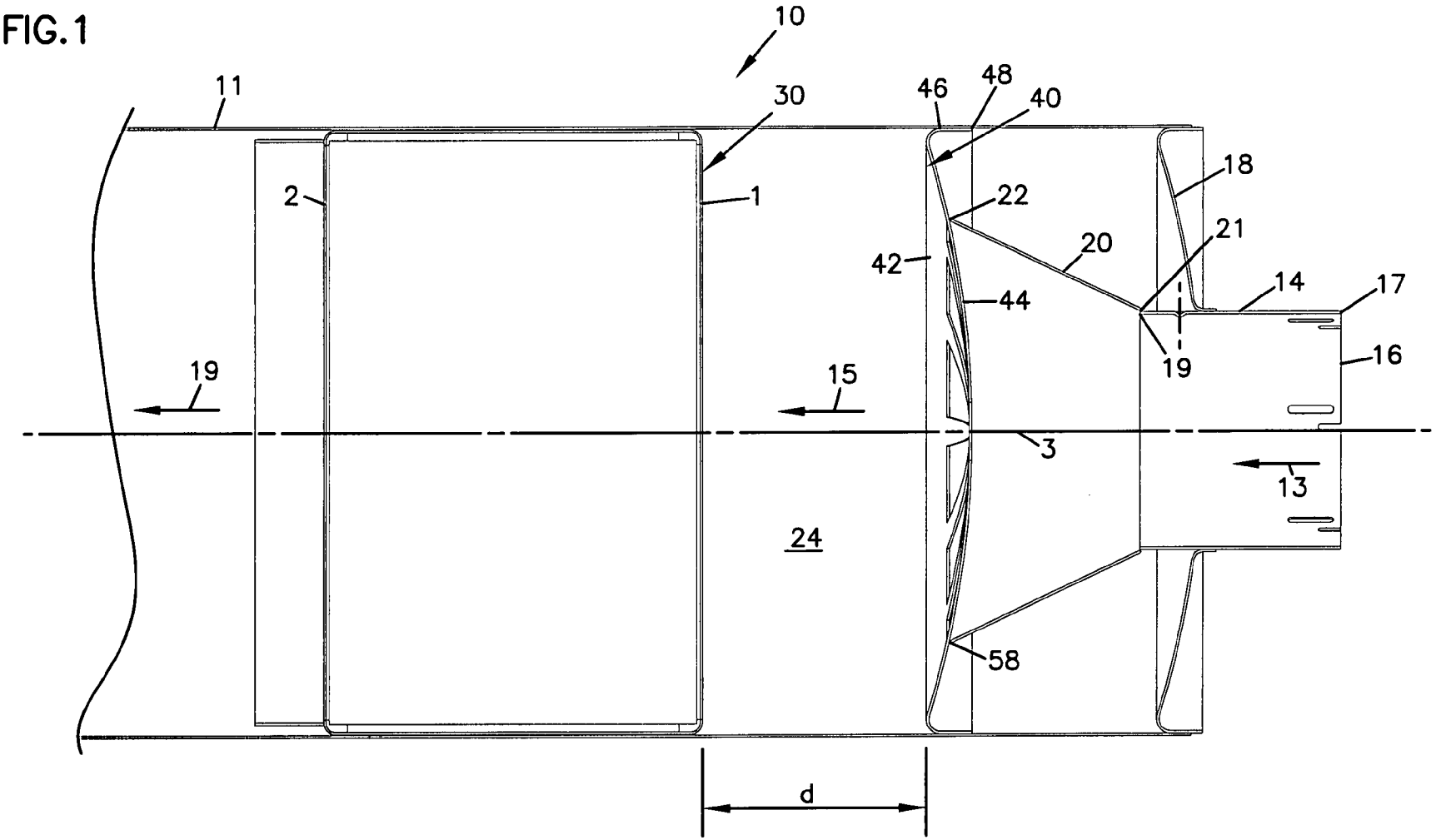
FIG. 1 is a cross-sectional view of a portion of a vehicle exhaust assembly having a flow distributor that includes features that are examples of inventive aspects in accordance with the principles of the present disclosure.

FIG. 1 is a schematic illustration of a portion of a vehicle exhaust system 10 that includes, among other elements, an exhaust conduit 11, an aftertreatment device 30 and a flow distributor element 40. Flow arrows 13, 15, and 19 illustrate that the direction of exhaust gas flow is from an upstream end 1 of the aftertreatment device 30 to a downstream end 2 of the aftertreatment device 30.

The flow distribution element 40 is preferably configured to improve exhaust flow uniformity across the upstream end 1 of the aftertreatment device 30 without generating significant back pressure in the exhaust system 10. The aftertreatment device 30 can include a structure such as a catalytic converter, diesel particulate filter, a lean NOx catalyst device, a selective catalytic reduction (SCR) catalyst device, a lean NOx trap, or other device for removing for removing pollutants from the exhaust stream.

Catalytic converters are commonly used to convert carbon monoxides and hydrocarbons in the exhaust stream into carbon dioxide and water. Diesel particulate filters are used to remove particulate matter (e.g., carbon based particulate matter such as soot) from an exhaust stream. Lean NOx catalysts are catalysts capable of converting NOx to nitrogen and oxygen in an oxygen rich environment with the assistance of low levels of hydrocarbons. For diesel engines, hydrocarbon emissions are too low to provide adequate NOx conversion, thus hydrocarbons are required to be injected into the exhaust stream upstream of the lean NOx catalysts. SCR's are also capable of converting NOx to nitrogen and oxygen. However, in contrast to using HC's for conversion, SCR's use reductants such as urea or ammonia that are injected into the exhaust stream upstream of the SCR's. NOx traps use a material such as barium oxide to absorb NOx during lean burn operating conditions. During fuel rich operations, the NOx is desorbed and converted to nitrogen and oxygen by catalysts (e.g., precious metals) within the traps.

Diesel particulate filters can have a variety of known configurations. An exemplary configuration includes a monolith ceramic substrate having a "honey-comb" configuration of plugged passages as described in U.S. Pat. No. 4,851,015 that is hereby incorporated by reference in its entirety. Wire mesh configurations can also be used. In certain embodiments, the substrate can include a catalyst. Exemplary catalysts include precious metals such as platinum, palladium and rhodium, and other types of components such as base metals or zeolites.

For certain embodiments, diesel particulate filters can have a particulate mass reduction efficiency greater than 75%. In other embodiments, diesel particulate filters can have a particulate mass reduction efficiency greater than 85%. In still other embodiments, diesel particulate filters can have a particulate mass reduction efficiency equal to or greater than 90%. For purposes of this specification, the particulate mass reduction efficiency is determined by subtracting the particulate mass that enters the filter from the particulate mass that exits the filter, and by dividing the difference by the particulate mass that enters the filter.

Catalytic converters can also have a variety of known configurations. Exemplary configurations include substrates defining channels that extend completely therethrough.

Exemplary catalytic converter configurations having both corrugated metal and porous ceramic substrates/cores are described in U.S. Pat. No. 5,355,973, that is hereby incorporated by reference in its entirety. The substrates preferably include a catalyst. For example, the substrate can be made of a catalyst, impregnated with a catalyst or coated with a catalyst. Exemplary catalysts include precious metals such as platinum, palladium and rhodium, and other types of components such as base metals or zeolites.

In one non-limiting embodiment, a catalytic converter can have a cell density of at least 200 cells per square inch, or in the range of 200-400 cells per square inch. A preferred catalyst for a catalytic converter is platinum with a loading level greater than 30 grams/cubic foot of substrate. In other embodiments the precious metal loading level is in the range of 30-100 grams/cubic foot of substrate. In certain embodiments, the catalytic converter can be sized such that in use, the catalytic converter has a space velocity (volumetric flow rate through the DOC/volume of DOC) less than 150,000/hour or in the range of 50,000-150,000/hour.

Still referring to FIG. 1, the depicted exhaust system 10 includes an inlet tube 14 positioned at an upstream end 13 of the conduit 11. The inlet tube 14 is aligned with a central longitudinal axis 3 of the conduit 11 and supported relative to the conduit 11 by an annular end cap 18. The inlet tube 14 includes a generally cylindrical construction having an upstream end 17 that is coincident with an inlet aperture 16 and a downstream end 19 that is connected to a tapered inlet conduit 20 (e.g., a truncated cone having a major diameter end 22 and a minor diameter end 21). The flow distributor element 40, which will be discussed in greater detail below, is positioned adjacent the major diameter end 22 of the tapered inlet conduit 20. The aftertreatment device 30 is located between the flow distributor element 40 and the downstream end 22 of the conduit 11. In one example embodiment, the upstream face of the aftertreatment device 30 is spaced a distance d from the flow distributor element 40, the distance d being in the range of 1-6 inches.

In use, the exhaust gases are directed into the exhaust conduit 11 through the inlet aperture 16 as indicated by arrows 13. The exhaust gases are then directed though the tapered inlet conduit 20 which allows for expansion of the gases as they flow toward the major diameter end 22 of the tapered conduit 20 and the approach the flow distributor element 40. The diffused exhaust gas interacts with and flows through the distributor element 40 and enters into an internal region or volume 24 of the exhaust system 10 defined by the conduit 11. Finally, the exhaust gas flows through the aftertreatment device 30 and out the downstream end of the conduit 11.

Now referring to both FIGS. 1 and 2, the flow distribution element 40 will be discussed in greater detail. The flow distribution element 40 is sized and configured such that it effectively distributes exhaust gas flow across the entire front or upstream end 1 (i.e., the upstream face or side) of the aftertreatment device 30 without generating an excessive amount of backpressure (i.e., without excessively impeding the forward flow of the exhaust gas) and without occupying a large amount of space. The distribution of exhaust flow on the upstream end 1 decreases the likelihood of exhaust gas overload to any given portion of the aftertreatment device 30 which also increases the effective lifetime of the aftertreatment device 30.

Figure 2:
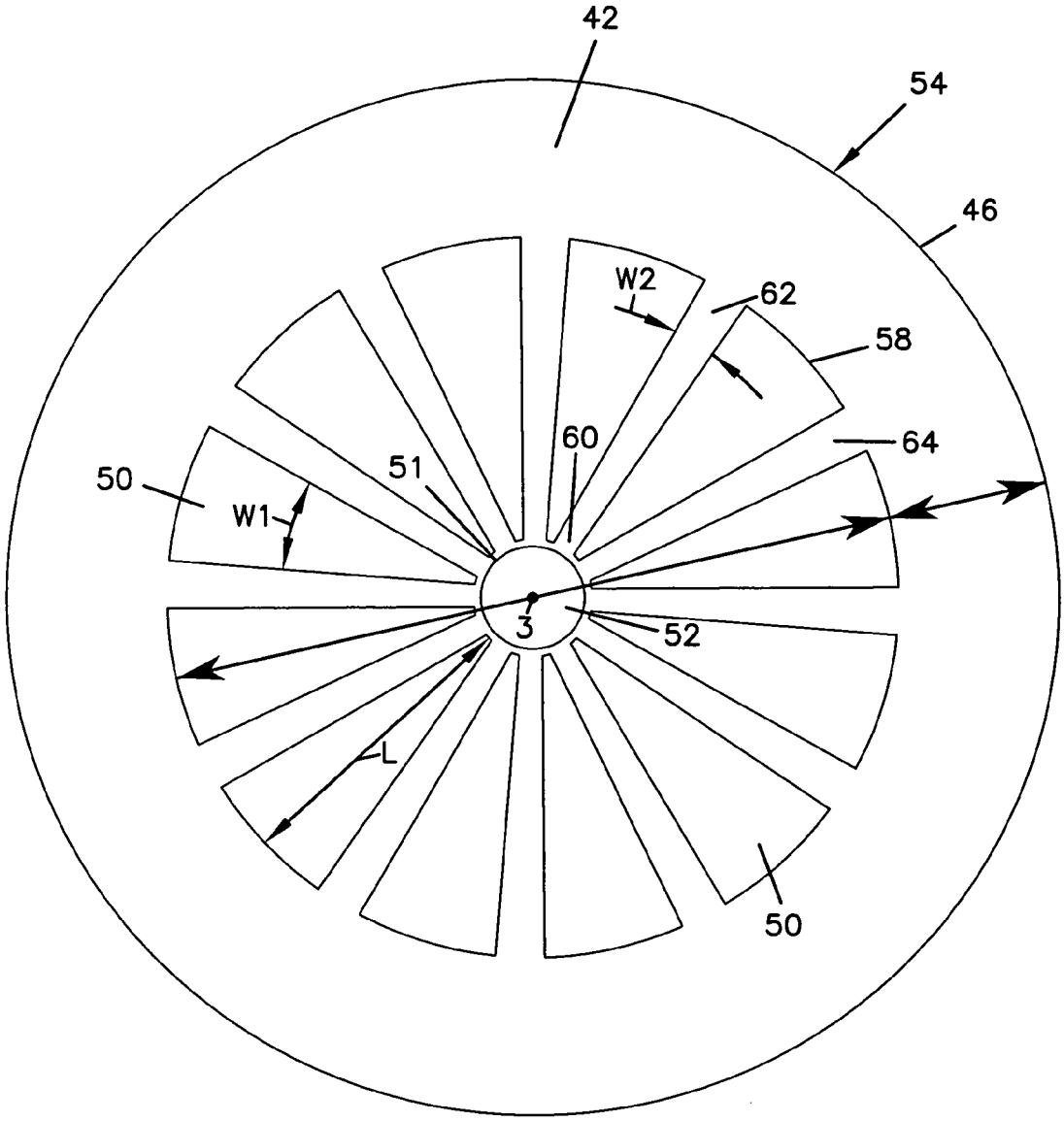
FIG. 2 is a plan view of the flow distributor of FIG. 1.

Still referring to both FIGS. 1 and 2, the flow distribution element 40 includes a plate 54 having a first major surface 42 facing in a downstream direction, and a second major surface 44 facing in an upstream direction. As shown, the plate 54 has a peripheral edge 46 that is sized and shaped to engage the inner surface of the exhaust conduit 11. The peripheral edge 46 can include a flange 48 that is arranged coaxially and adjacent the inner surface of the conduit 11 to aid in positioning and supporting the plate 54 within the conduit 11. The plate 54 is positioned adjacent the major diameter end 22 of the diffuser 20. The major diameter end 22 of the diffuser 20 contacts the flow distribution element 40 at an intermediate peripheral boundary 58. The area of the plate 54 surrounded by the intermediate periphery boundary 58 is directly in the path of the gas flow stream passing through the tapered inlet conduit 20.

Referring specifically to FIG. 2, the plate 54 includes a plurality of flow-distribution holes 50. The holes 50 are elongated along lengths L that extend radially outwardly from a central region 51 of the plate 54. The central region 51 is preferably aligned generally with the central longitudinal axis 3 of the conduit 11. The holes 50 have widths W1 that continuously increase as the lengths L extend radially away from central region 51. Thus, the sizes of the holes 50 increase as the holes extend away from the central region 51. Also, the percentage of open area of the plate 54 increases as the openings extend away from the central region 51. This hole configuration assists in distributing exhaust gas flow radially outwardly to provide improved flow distribution at the aftertreatment device 30. The region of the plate 54 between the boundary 58 and the outermost peripheral edge 46 preferably does not include holes.

In the embodiment shown, the plate 54 includes a generally circular aperture 52 disposed at the center of the plate 54 and twelve pie or wedge shaped flow-distribution holes 50 disposed evenly around the circular aperture 52. The wedge shaped apertures are separated by radially extending strips of plate referred to herein as deflectors 64. In the embodiment shown, the deflectors 64 are uniform in shape with a width W2 that remains relatively constant from a first end 60 near the center of the plate 54 to a second end 62 near the periphery of the plate 54. However, it will be appreciated that the shapes of the deflectors can be varied without departing from the principles of the present invention.

It is also noted that a majority of the region of the plate 54 defined within the intermediate peripheral boundary 58 is open to allow exhaust flow to pass therethrough. In certain embodiments, the sum of the open spaces within the boundary 58 divided by the overall area defined inside the boundary 58 is greater than or equal to 75 percent. In other words, the plate 54 is at least seventy-five percent open and less than twenty-five percent closed within the boundary 58. It should be appreciated that a number of different arrangements and shapes of apertures are possible. The open configuration of the plate assists in minimizing the backpressure generated by the plate 54. The tapered transition provided by the tapered inlet conduit 20 also assists in minimizing backpressure.

Referring to FIG. 1, to further enhance flow distribution, the upstream side 44 of the plate 54 is convex and the downstream side 42 of the plate is concave. However, in other embodiments the plate could be flat, conical or any number of different shapes.

The above-described convex configuration is advantageous since it inhibits "oil canning" or fluctuation under heavy flow and vibration conditions. In addition, the convex configuration allows the plate 54 to direct the flow to the periphery of the flow path without impeding the flow by abruptly changing its direction. In the embodiment shown, no major surface of the plate 54 within the intermediate periphery edge 58 is disposed perpendicular to the longitudinal axis 3 of the muffler assembly 10. Such a construction enables the plate 54 to modify the natural non-uniform flow profile to a more uniform flow profile without significantly decreasing the overall flow rate.

Figure 3:
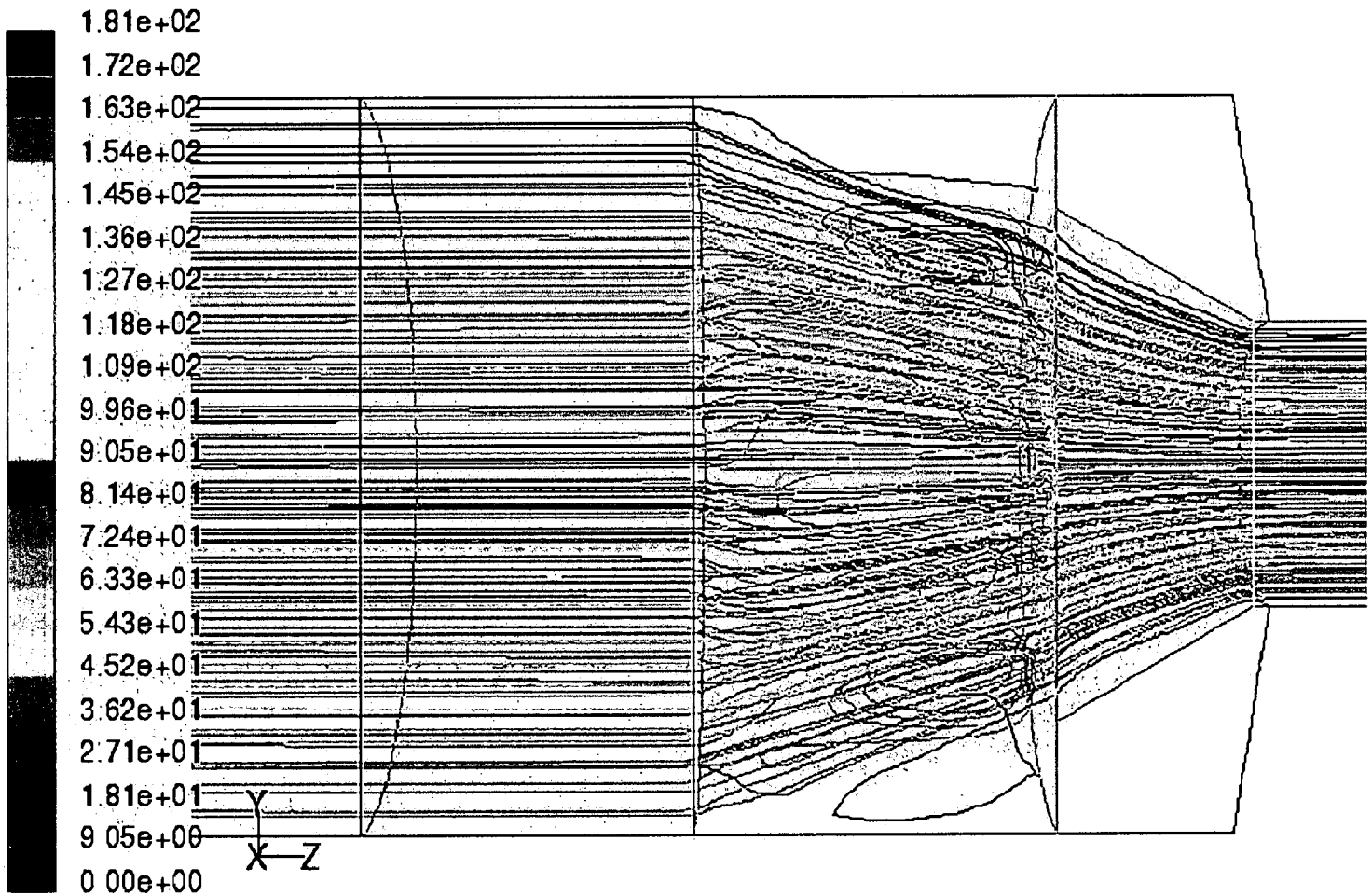
FIG. 3 is a flow model showing an example flow pattern generated by a flow distributor of the type shown in FIGS. 1 and 2.

FIG. 3 shows flow modeling for a flow distribution device having features in accordance with the principles of the present disclosure. The depicted embodiment includes an exhaust conduit having a diameter in the range of 10-14 inches, and a flow distribution device having flow distribution openings that have radial lengths of about 9 inches. The modeling shows that such a configuration provides substantially uniformly distributed flow across the upstream face of the aftertreatment device. The flow distribution device provides effective flow distribution while causing reduced back pressure as compared to conventional flow distribution techniques.

Figure 4:
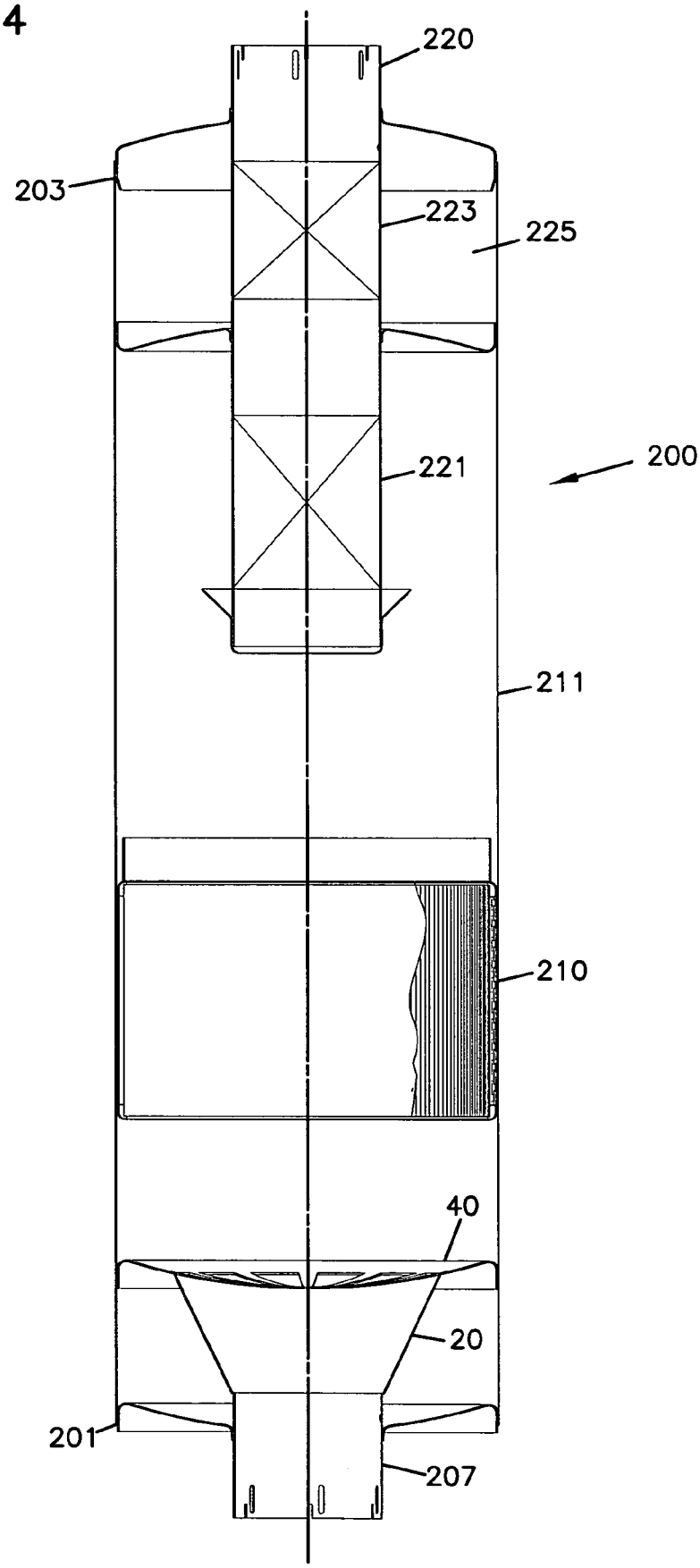
FIG. 4 shows an example catalytic converter muffler having a flow distribution device that includes features that are examples of inventive aspects in accordance with the principles of the present disclosure.

FIG. 4 shows a vertical catalytic converter muffler 200 incorporating the flow distribution element 40 and tapered inlet conduit 20. The muffler 200 includes a muffler body 211 having an inlet end 201 and an outlet end 203. The tapered inlet conduit 20 and flow distribution element 40 are mounted at an inlet pipe 207 of the muffler 200. The element 40 distributes exhaust flow across a diesel oxidation catalyst 210 (i.e., a catalytic converter) mounted within the muffler body 211. The muffler 200 also includes an outlet pipe 220 mounted at the outlet end 203 of the muffler body 211. The outlet pipe 220 has a capped lower end that prevents water from wetting the diesel oxidation catalyst 210. The outlet pipe 220 also includes a first perforated region 221 for allowing exhaust gas from within the body 211 to enter the outlet pipe 220, and a second perforated region 223 in fluid communication with an expansion chamber 225 for muffling exhaust noise.

Figure 5:
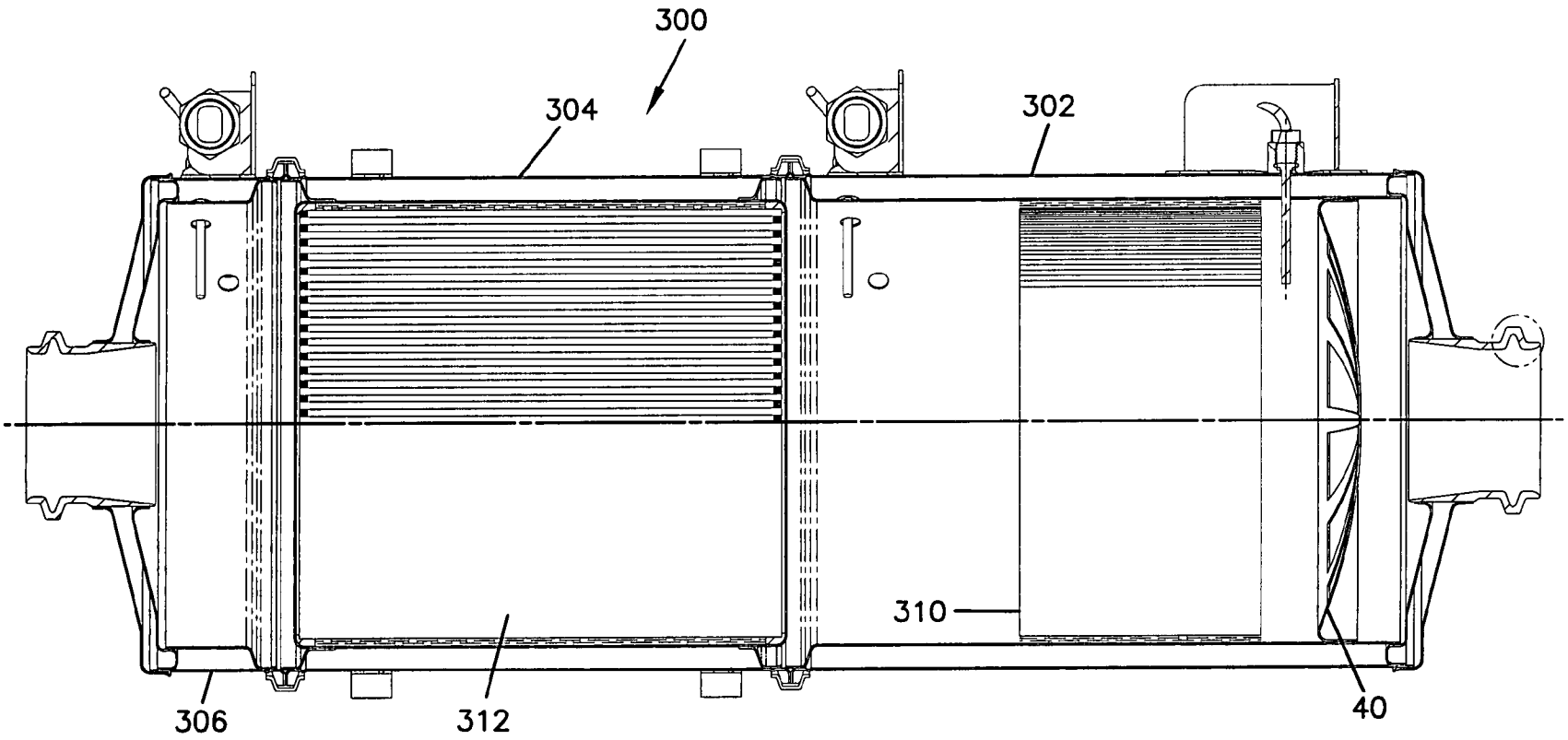
FIG. 5 shows an example exhaust aftertreatment component having a flow distribution device that includes features that are examples of inventive aspects in accordance with the principles of the present disclosure.

FIG. 5 shows a double-walled exhaust aftertreatment component 300 having an inlet piece 302, an intermediate piece 304, and an outlet piece 306. The pieces 302, 304 and 306 are secured together by clamps (e.g., v-band clamps). A catalytic converter 310 is mounted in the inlet piece 302 and a diesel particulate filter 312 is mounted in the intermediate piece. The flow distributor 40 is mounted within the inlet piece 302 at a location upstream from the catalytic converter 310. Further details regarding the aftertreatment component 300 can be found at U.S. patent application Ser. No. 11/223,460, entitled "Construction for an Engine Exhaust System Component", filed on Sep. 8, 2005, which application is hereby incorporated by reference in its entirety.

It will be appreciated that flow distribution element 40 can also be used with other muffler configurations such as horizontal mufflers. Also, in other embodiments, multiple aftertreatment devices (e.g., multiple catalytic converters, multiple diesel particulate filters, or combinations of catalytic converters and diesel particulate filters) can be mounted in the muffler downstream from the flow distributor. Moreover, flow distribution elements in accordance with the present disclosure can be used in other types of exhaust conduits in addition to muffler bodies.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A vehicle exhaust apparatus comprising:

an exhaust conduit;

an exhaust aftertreatment device configured to remove pollutants from an exhaust stream positioned within the exhaust conduit, the exhaust aftertreatment device including an upstream face and a downstream face;

an inlet for directing exhaust gas into the exhaust conduit; and a flow distribution arrangement positioned upstream from the aftertreatment device for distributing flow across the upstream face of the aftertreatment device, the flow distribution arrangement including a plate having:

a concave side that faces the exhaust aftertreatment device and a convex side that faces the inlet;

at least 6 wedge-shaped flow distribution openings defined by the plate that extend radially outwardly from a central region of the plate, wherein the flow distribution openings increasing in size as the flow distribution openings extend radially away from the central region of the plate;

radial flow distribution members that separate the flow distribution openings, wherein the radial flow distribution members are interconnected at the central region of the plate with each having a generally constant width; and a boundary defined by the inlet at the convex side of the plate, wherein a sum of an area defined by each of the flow distribution openings within the boundary divided by a total area within the boundary is greater than or equal to 75 percent.

2. A vehicle exhaust apparatus as claimed in claim 1, wherein interconnections of the radial flow distribution members form a ring in the center region that defines a circular aperture.

* * * * *